US005684368A

United States Patent [19]

Wei et al.

[11] Patent Number: 5,684,368

[45] Date of Patent: Nov. 4, 1997

[54] SMART DRIVER FOR AN ARRAY OF LEDS

[75] Inventors: Chengping Wei, Gilbert; Franky So, Tempe; Michael P. Norman, Chandler, all of Ariz.

[73] Assignee: Motorola, Schaumburg, Ill.

[21] Appl. No.: 660,827

[22] Filed: Jun. 10, 1996

[51] Int. Cl.[6] ..... G05F 1/00

[52] U.S. Cl. ..... 315/302; 315/169.3; 315/297; 315/316; 345/82; 345/83

[58] Field of Search ..... 315/169.3, 169.1, 315/169.4, 297, 308, 292, 294, 316, 300, 302; 257/40, 88; 313/504, 506; 345/82, 83, 211–213, 60, 76

[56] References Cited

U.S. PATENT DOCUMENTS

| | | | |
|---|---|---|---|
| 4,048,632 | 9/1977 | Spence | 345/82 X |
| 4,447,762 | 5/1984 | Williams | 315/169.3 X |
| 4,642,524 | 2/1987 | Eaton et al. | 315/169.3 |
| 4,897,639 | 1/1990 | Kanayama | 345/82 X |
| 4,967,192 | 10/1990 | Hirane et al. | 345/82 X |
| 5,184,114 | 2/1993 | Brown | 345/83 X |
| 5,424,560 | 6/1995 | Norman et al. | 257/40 |
| 5,473,222 | 12/1995 | Thoeny et al. | 315/169.1 |
| 5,483,503 | 1/1996 | Kimball | 315/169.3 X |

*Primary Examiner*—Robert Pascal
*Assistant Examiner*—Haissa Philogene
*Attorney, Agent, or Firm*—Eugene A. Parsons

[57] ABSTRACT

A smart driver in combination with an LED including a column driver coupled to one terminal of the light emitting device and a row driver coupled to another terminal of the light emitting device to form an addressed circuit. A controllable power supply having terminals coupled to the column and row drivers and a control terminal connected to control power applied between the terminals in response to a control signal supplied thereto. A control circuit coupling the addressed circuit to the control terminal and supplying a unique control signal thereto, whereby a unique amount of power is applied to the addressed circuit.

7 Claims, 3 Drawing Sheets

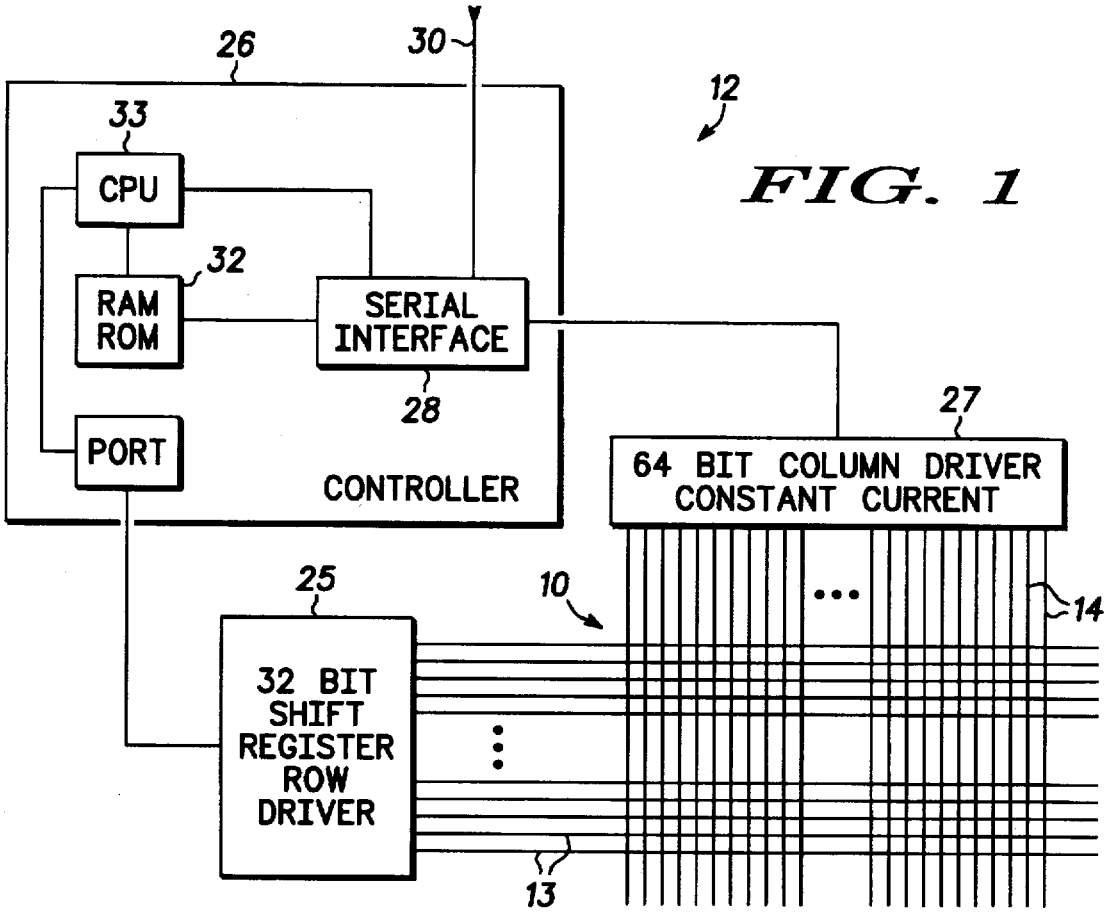
FIG. 1
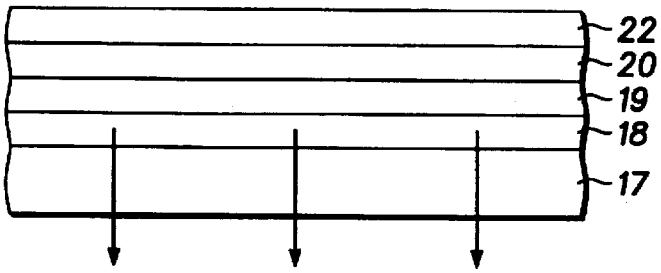
15 FIG. 2

SMART DRIVER FOR AN ARRAY OF LEDS

FIELD OF THE INVENTION

The present invention pertains to arrays of light emitting devices and more specifically to apparatus for addressing and driving the arrays.

BACKGROUND OF THE INVENTION

Arrays of light emitting devices are becoming very popular as displays in portable electronic devices and the like. Arrays of organic light emitting devices are especially desirable because of the ease of fabrication. Also, organic light emitting devices are relatively bright, all, or most, of the colors desired are relatively easy to achieve, and the cost of fabrication and operation are relatively low. However, to fabricate organic light emitting devices it is necessary to form at least one transparent electrically conductive terminal for the emission of light therethrough. Generally, the electrically conductive terminal is formed of organic or inorganic conductors, such as conductive polyaniline (PANI) or indium-tin-oxide (ITO), which are substantially transparent to visible light so that the emitted light exits through the substrate. The transparent electrically conductive material from which the contact is formed, i.e. indium-tin-oxide (ITO) or the like, has a relatively high resistance so that forming it into row or column conductors in the array substantially increases the resistance between column drivers, an addressed light emitting device, and a row driver. For example, if the columns are formed of ITO with a driver connected to each column, the light emitting device at the first row crossing has a resistance between it and the column driver of one unit. The light emitting device at the second row crossing has a resistance between it and the column driver of two units. Further, the light emitting device at the $n^{th}$ row crossing has a resistance between it and the column driver of n units. Thus, the voltage dropped across each separate light emitting device in a column changes. Also, aging, use, etc. have a tendency to change the amount of current (or applied voltage) required to maintain a uniform brightness.

It is a purpose of the present invention to provide new and improved smart drivers for arrays of light emitting devices.

It is another purpose of the present invention to provide new and improved smart drivers for arrays of light emitting devices which are capable of maintaining the brightness of each light emitting device in the array relatively constant.

It is a further purpose of the present invention to provide new and improved smart drivers for arrays of light emitting devices which are capable of compensating for changes in light emitting devices and the associated circuits, due to age, use, etc.

SUMMARY OF THE INVENTION

The above problems and others are substantially solved and the above purposes and others are realized in a smart driver in combination with a light emitting device having first and second terminals and an associated resistance. A column driver is coupled to the first terminal of the light emitting device and a row driver is coupled to the second terminal of the light emitting device to form an addressed circuit including the associated resistance. A controllable power supply has a first power terminal coupled to the column driver, a second power terminal coupled to the row driver, and a control terminal connected to control power applied between the first and second power terminals in response to a control signal supplied to the control terminal. The light emitting device and the associated resistance form an addressed circuit in conjunction with the column driver and the row driver. A control circuit couples the addressed circuit to the control terminal of the controllable power supply and a unique control signal is supplied to the control terminal of the power supply, whereby a unique amount of power is applied to the addressed circuit.

BRIEF DESCRIPTION OF THE DRAWINGS

Referring to the drawings:

FIG. 1 is a simplified block diagram of a light emitting device array with drive apparatus connected thereto;

FIG. 2 is a simplified sectional view of a typical organic light emitting device;

DESCRIPTION OF THE PREFERRED EMBODIMENT

Figure 3:
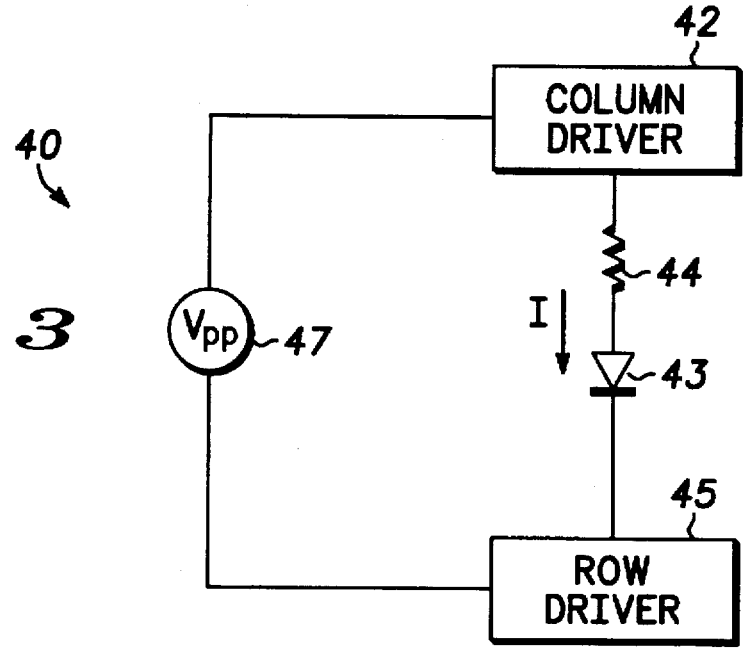
FIG. 3 is block/schematic representation of a single addressed drive circuit.

Referring specifically to FIG. 1, a simplified block diagram of a light emitting device array 10 is illustrated with drive apparatus 12 connected thereto. In this specific embodiment array 10 includes a plurality of organic light emitting devices (LEDs) connected into thirty two rows and sixty four columns. Thirty two row terminals 13 are illustrated at the left side of array 10 in FIG. 1 and sixty four column terminals 14 are illustrated at the top. While most of the discussion herein is directed to organic LED arrays because of their novel resistance problem, it should be understood that other types of LED arrays (i.e. semiconductor LEDs, LCDs, semiconductor laser arrays, etc., may have similar problems, in which case the present invention may be useful for these applications. Generally, when fabricating large arrays of LEDs it is common practice to bring every-other terminal to the opposite side of the array so that the pitch (distance between adjacent terminals) is increased, or to lower the resistance by a factor of two. However, the terminals are all illustrated on the same side in this instance to simplify the drawings. It will of course be understood that any number of rows and columns of LEDs can be provided and that the present example is only utilized for illustrative purposes.

A typical organic LED 15 is illustrated in a simplified cross-sectional view in FIG. 2. Generally, either the anode (positive electrical contacts) or the cathode (negative electrical contacts) of an organic LED must be optically transparent to allow the emission of light therethrough. In this embodiment organic LED 15 includes a substrate 17 which is formed of a transparent material, such as glass, quartz, or a hard plastic or the like. Even some semiconductor materials are transparent to light and may be utilized as substrate 17, in which instance some of the electronics may be integrated directly onto the substrate. A positive conductive layer 18 is patterned onto the upper surface of substrate 17 in any of the many well known procedures, e.g. using photoresist or the like. Conductive layer 18 is patterned into a plurality of parallel spaced apart columns terminating in terminals 14 (FIG. 1). While conductive layer 18 may be formed of any organic or inorganic conductors, such as conductive polyaniline (PANI) or indium-tin-oxide (ITO), which are substantially transparent to visible light, in this specific example, conductive layer 18 is provided as a layer of ITO.

A hole transport layer 19 is positioned on the upper surface of layer 18. Generally, for convenience in manufacturing array 10, layer 19 is deposited as a blanket deposition over the upper surface of layer 18 and any exposed portions of substrate 17, since only the portion of layer 19 which overlies layer 18 will be activated. An electron transport and light emission layer 20 is positioned over the upper surface of layer 19. It should be understood that organic devices are presently being fabricated with one to several organic layers and organic LED 15 is only illustrated for purposes of this explanation. Also, to reduce the potential required in embodiments not incorporating an electron transport layer, a cathode is generally formed of a layer 22 of low work function metal/conductors or combination of metals/conductors, at least one of which typically has a low work function. In this embodiment the cathode (layer 22) is formed of low work function material, such as the commonly used lithium or magnesium, or the cathode may be a conductive metal incorporating cesium, calcium or the like.

A list of some possible examples of materials for the organic layer or layers (e.g. 19 and 20) of the above described organic LEDs follows. As a single layer of organic, some examples are: poly(p-phenylenevinylene) (PPV); poly(p-phenylene) (PPP); and poly[2-methoxy,5-(2'-ethylhexoxy)1,4-phenylenevinylene] (MEH-PPV). As an electron transporting electroluminescent layer between a hole transporting layer or one of the single layer organics listed above and a low work function metal cathode, an example is: 8-hydroxquinoline aluminum (ALQ). As an electron transporting material, an example is: 2-(4-tert-butylphenyl)-5-(p-biphenylyl)-1,3,4-oxadiazole (butyl-PBD). As a hole transport material, some examples are: 4,4'-bis[N-phenyl-N-(3-methylphenyl)amino]biphenyl (TPD); and 1,1-bis(4-di-p-tolyaminophenyl)cyclohexane. As an example of a fluorescent that may be used as a single layer or as a dopant to an organic charge transporting layer is coumarin 540, and a wide variety of fluorescent dyes. Examples of low work function metals include: Mg:In, Ca, and Mg:Ag.

While array 10 (FIG. 1) is described as having a single organic LED for each pixel of an image, it should be understood that additional LEDs can be connected in parallel for additional brightness or redundancy. Also, an example of the incorporation of multiple LEDs in a single pixel to produce multiple colors, or full color, is disclosed in U.S. Pat. No. 5,424,560, entitled "Integrated Multicolor Organic LED Array", issued Jun. 13, 1995 and assigned to the same assignee.

Each LED in array 10 includes one or more layers of polymers or low molecular weight organic compounds, generally as described above. Hereinafter, for simplification of this disclosure, the term organic/polymer will be shortened to "organic" but it should be understood that this term is intend to encompass all polymers or low molecular weight organic compounds. The organic materials that form layers 19 and 20 are chosen for their combination of electrical, luminescent and color properties, and various combinations of hole injecting, hole transporting, electron injecting, electron transporting, and luminescent or emitting materials can be used.

In general, in organic electroluminescent or LED devices it should be understood that organic layers 19 and 20 do not conduct electrons well and the electron resistivities (e.g., approximately $10e^{-7}$) are much higher than the hole resistivities (e.g., approximately $10e^{-3}$) in the same material. Also, electron transport layer 20 conducts electrons relatively well but does not conduct holes well and can thus be thought of as a hole blocking layer. Further, it should be understood that generally light, or photons, are generated when electrons and holes combine. Thus, because holes are transported readily through organic layers 19 and 20 and because electrons are transported readily through electron transport layer 20, substantially all recombination of holes and electrons occurs at or near the junction of layers 19 and 20, but usually in layer 20. As the materials of layers 19 and 20 age (electrical current passes therethrough), there is a tendency for various particles and defects to migrate within the material, causing the light emission to spread into less efficient material.

Referring again to FIG. 1, drive apparatus 12 includes a circuit for periodically cycling through the 32 rows of array 10. In the simplified block diagram of FIG. 1 this circuit is illustrated as a 32 bit shift register, row driver 25. Shift register, row driver 25 is connected to a controller 26, which supplies clock pulses and any other driving information which may be required. A 64 bit column driver 27 is connected to column terminals 14 and supplies image data thereto. Generally, column driver 27 includes an individual driver for each column terminal 14 and a buffer or the like for storing a complete row of image information. Column driver 27 is connected to controller 26 for receiving each new row of image information therefrom.

Controller 26 includes a serial interface 28 which supplies image data to column driver 27 and which optionally receives video or image data from an external data input 30. Serial interface 28 is also connected to a RAM/ROM memory 32 and to a central processing unit (CPU) 33, or the like. CPU 33 controls both column drivers 27 and shift register 25 and utilizes memory 32 to generate images on array 10. It will of course be understood by those skilled in the art that a wide variety of circuits can be utilized to control array 10 and controller 26, along with shift register, row driver 25 and column drivers 27, are simply one embodiment utilized for purposes of explanation herein.

Turning now to FIG. 3, a block/schematic representation of a single addressed drive circuit 40 is illustrated. Addressed drive circuit 40 includes a single column driver 42, which is a single selected or addressed driver from column drivers 27 of FIG. 1. Column driver 42 is connected to the light emitting device or devices of a pixel 43 (represented as a single light emitting diode) through an associated resistance 44 (which is considered a part of pixel 43 for this explanation). Associated resistance 44 represents the resistance of the column conductor for array 10, as well as the row conductor and any resistance of the LEDs themselves.

Assume for purposes of this explanation that array 10 is constructed with a light emitting device (e.g. device 15) connected between each crossing of each column conductor (terminals 14) and each row conductor (terminals 13). Conductive layer 18 is patterned on substrate 17 to form the column conductors and terminals 14. Layer 22 is patterned to form the row conductors and terminals 13. As explained above, because conductive layer 18 must be transparent to the light generated by the devices, it generally has a relatively high resistance. Further, since the rows are cycled ON one row at a time, the maximum number of devices that will be conducting in a column at a time is one. Thus, each of the column conductors will carry a maximum current equal to the current conducted by one LED 15 (e.g. approximately 1–2 mA).

Assuming, for example, that ITO is used to form the column conductors, the resistivity ranges from about 7.5 ohms/square to 400 ohms/square. While the resistivity can be lowered by increasing the thickness of the column conductors, there are problems with uniformity of ITO which can lead to device defects as the conductor is thickened. Thus, a typical column conductor formed of ITO may be approximately 50 ohms/square. The resistance along a column conductor between adjacent rows would then be about 80 ohms. Over 30 rows, at 80 ohms/row, this results in a total of over 2.4 kohms of resistance between the first and the last LED in the column. Since one LED draws a current of approximately 1–2 mA, this gives a 2–5 volt difference for driving the same current into the last LED versus the first LED in the column. When the LEDs are voltage driven, this variation in voltage over the length of a column means that additional compensation circuitry is required to provide uniform brightness of the LEDs across the entire array 10.

Any number from zero to all of the devices connected into each row may be conducting simultaneously (depending upon the image) so that each of the row conductors (layer 22), may be required to carry the current of all of the devices (e.g. 64×approximately 1–2 mA). Thus, the row conductors are generally formed of a metal having as low a resistance as practical. However, due to the long, thin rows in array 10, the resistance for a row conductor may still be as much as 5 ohms. If, for example, enough LEDs are conducting in a row to draw 100 mA of current, this 5 ohms of resistance produces a voltage drop of 0.5 volts from one end of the row conductor to the other. Thus, it is clear that resistor 44 of each pixel (diode 43) in array 10 varies in accordance with its position, age, use, etc.

Addressed drive circuit 40 further includes a single row driver 45, which is a single selected or addressed driver from shift register, row drivers 25 of FIG. 1. Row driver 45 is connected to a second terminal of pixel 43 to complete addressed circuit 40. When circuit 40 is addressed, a power supply 47 has one terminal connected to column driver 42 and a second terminal connected to row driver 45 as illustrated in FIG. 3. It will be understood by those skilled in the art that each pixel in array 10 has a unique address that is defined by a specific column driver and row driver, and the combination of the column driver, pixel and row driver form an addressed circuit which, by the act of addressing is connected to power supply 47.

The power consumption of each addressed array is different, generally because of the differences in the resistance (resistor 44). To explain the power consumption, FIG. 3 has been provided and is representative of all or any of the pixels of array 10. The power consumption of addressed circuit 40 is determined by:

$$P_d = I(V_{d1}+V_{d2}) = I(V_{pp}-V_D) = IV_{pp}-IV_D$$

Where: $P_d$ is the total power consumption of circuit 40;

I is the current through circuit 40;

$V_{d1}$ is the voltage dropped across column driver 42;

$V_{d2}$ is the voltage dropped across row driver 45;

$V_D$ is the voltage dropped across pixel 43; and $V_{pp}$ is the voltage provided by power supply 47.

Thus, it can be seen that $V_{pp}$, the voltage provided by power supply 47, is directly related to the power consumption of the pixel.

Figure 4:
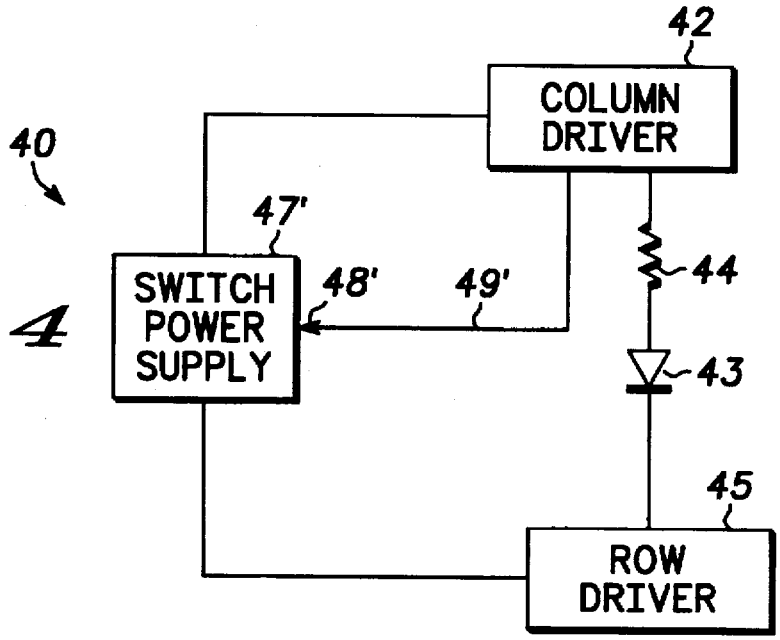
FIG. 4 is a block/schematic representation of a single addressed drive circuit in accordance with the present invention.

Turning now to FIG. 4, addressed drive circuit 40 including single column driver 42, pixel 43 (including resistance 44 and a light emitting device), and single row driver 45 are illustrated. Power supply 47 of FIG. 3 is replaced with a controllable or switching power supply 47' has one terminal connected to column driver 42 and a second terminal connected to row driver 45 as illustrated in FIG. 4. Also, switching power supply 47' has a control terminal 48' adapted to receive control signals thereon for controlling the output power of switching power supply 47'. In this example, output power control is performed by controlling $V_{pp}$, since the current 'I' conducted through pixel 43 is substantially constant to achieve a constant lumination.

A control circuit 49' is attached between addressed circuit 40 and control terminal 48' of switching power supply 47'. In this embodiment control circuit 49' is attached to column driver 42 to sense changes in voltage drop generally across resistance 44, since the other voltage drops are substantially constant. It should be understood, however, that other points of addressed circuit 40 might be utilized and other sensing devices might be utilized, e.g. a current sensor might be incorporated in addressed circuit 40. As the voltage drop at column driver 42 changes, control circuit 49' provides a control signal at control terminal 48' to change the output power (voltage) to tend to maintain the voltage drop at column driver 42 substantially constant. Control circuit 49' provides a unique control signal to control terminal 48' of controllable power supply 47', whereby a unique amount of power is applied to each of the addressed circuits of array 10.

Figure 5:
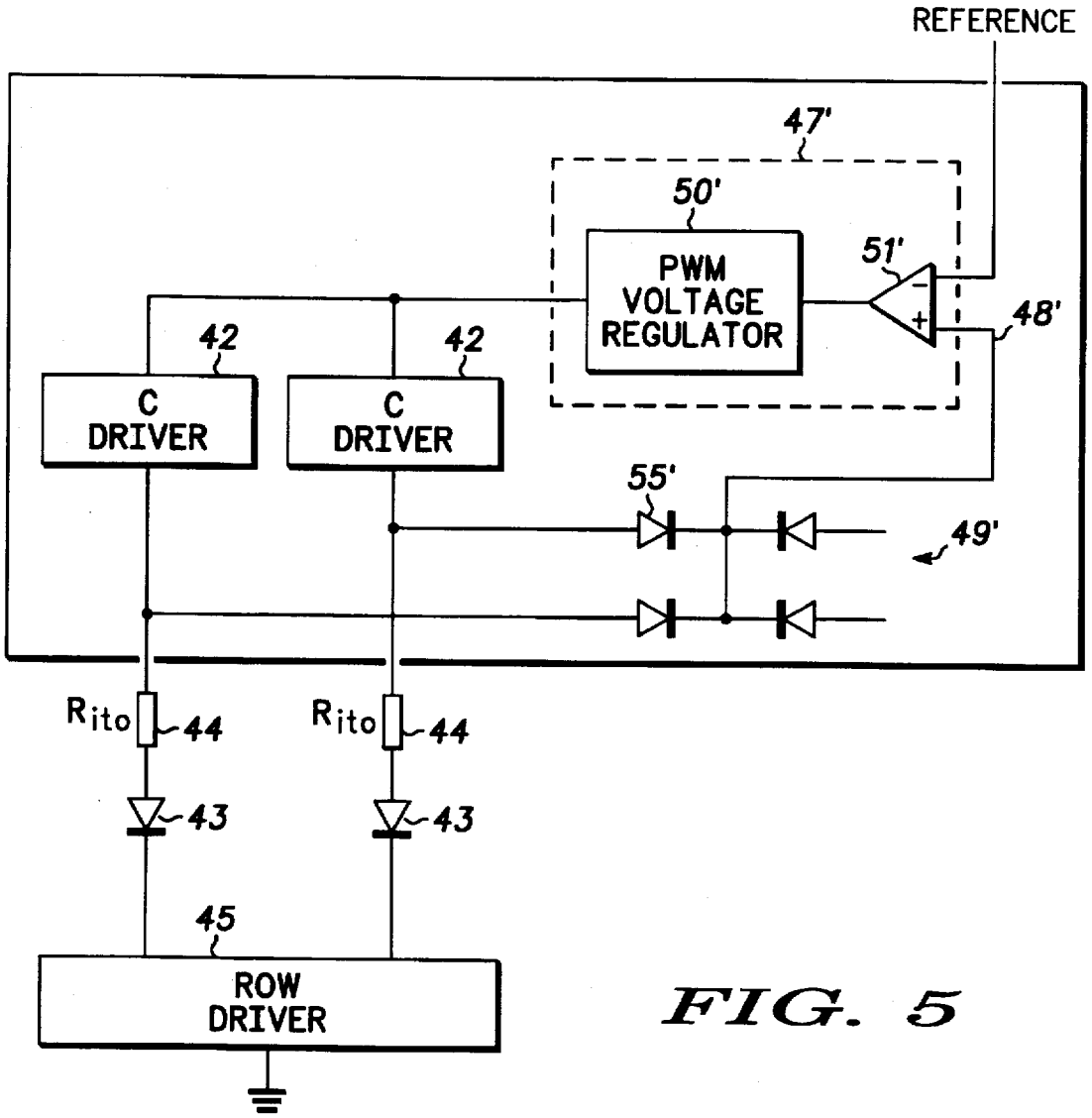
FIG. 5 is a simplified schematic/block diagram illustrating in more detail, drive circuits in accordance with the present invention.

Referring now to FIG. 5, a simplified schematic/block diagram is illustrated showing in more detail, drive circuits in accordance with the present invention. As illustrated in FIG. 4, each column driver 42 (only two illustrated for convenience) is connected by an ITO column conductor (resistor 44) to one side of a light emitting device 43, the other side of which is connected through row driver 45 (or drivers) to an electrical return. Further, controllable power supply 47', is connected to supply power to light emitting devices 43 through each addressed column driver. In this specific embodiment, controllable power supply 47' includes a regulated source of power, such as pulse width modulated voltage regulator 50', and a comparator 51' connected thereto for controlling the voltage or power output. Each control circuit 49', in this specific embodiment, includes a diode 55' connected between one input of comparator 51' and the output of the associated column driver 42. Essentially, the voltage dropped across the addressed circuit 40 is applied to the input of comparator 51'. A reference voltage is applied to a second input of comparator 51' and, if the voltage dropped across the addressed circuit 40 exceeds the reference voltage, i.e. a unique control signal is applied to control terminal 48' of voltage regulator 50', the voltage supplied by voltage regulator 50' is adjusted accordingly, whereby a unique amount of power is applied to each of the addressed circuits of array 10.

Thus, the novel circuit described dynamically controls the output power, or voltage, of the controllable power source by means of feedback compensation from the addressed circuit to controllable power source 47'. This feedback compensation provides optimized voltage to each addressed circuit which reduces driver power consumption. Total power consumption is also reduced because driver voltages are regulated by high efficiency controllable power source 47' Because of the small, optimized power consumption, the disclosed smart driver in combination with an array of light emitting devices is very useful in displays in portable electronic devices.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A smart driver in combination with a light emitting device comprising:

a light emitting device having first and second terminals and an associated resistance;

a column driver coupled to the first terminal of the light emitting device and a row driver coupled to the second terminal of the light emitting device to form an addressed circuit including the associated resistance;

a controllable power supply having a first power terminal coupled to the column driver, a second power terminal coupled to the row driver, and a control terminal connected to control power applied between the first and second power terminals in response to a control signal supplied to the control terminal, the light emitting device and the associated resistance forming an addressed circuit in conjunction with the column driver and the row driver; and a control circuit coupling the addressed circuit to the control terminal of the controllable power supply and supplying a unique control signal to the control terminal of the power supply, whereby a unique amount of power is applied to the addressed circuit.

2. A smart driver in combination with a light emitting device as claimed in claim 1 wherein the light emitting device includes an organic light emitting device.

3. A smart driver in combination with an array of light emitting devices comprising:

a plurality of light emitting devices arranged in an array of columns and rows of pixels, each pixel having an associated resistance and current requirement;

a plurality of column drivers and a plurality of row drivers coupled to the columns and rows of pixels, respectively;

a controllable power supply having a first power terminal coupled to each of the plurality of column drivers, a second power terminal coupled to each of the plurality of row drivers, and a control terminal connected to control power applied between the first and second power terminals in response to a control signal supplied to the control terminal, each pixel and the associated resistance forming an addressed circuit in conjunction with a unique combination of column driver and row driver coupled thereto; and a control circuit coupling each addressed circuit to the control terminal of the controllable power supply and supplying a unique control signal to the control terminal of the power supply for each addressed circuit whereby a unique amount of power is applied to each addressed circuit.

4. A smart driver in combination with an array of light emitting devices as claimed in claim 3 wherein the plurality of light emitting devices arranged in an array of columns and rows of pixels includes organic light emitting devices.

5. A smart driver in combination with an array of light emitting devices as claimed in claim 4 wherein the plurality of light emitting devices arranged in an array of columns and rows of pixels includes a light transparent substrate with the columns of pixels defined by strips of light conductive transparent material formed on the substrate and the plurality of light emitting devices formed on the light conductive transparent material so that the light conductive transparent material defines a first terminal for each of the plurality of light emitting devices, whereby the strips of light conductive transparent material forms a substantial portion of the associated resistance for each pixel.

6. A method of supplying power to an array of light emitting devices comprising the steps:

providing a plurality of light emitting devices arranged in an array of columns and rows of pixels, each pixel having an associated resistance and current requirement;

providing a plurality of column drivers and a plurality of row drivers coupled to the columns and rows of pixels, respectively;

selecting a specific pixel and the associated resistance and forming an addressed circuit in conjunction with a unique column driver and a unique row driver coupled to the selected pixel;

providing a controllable power supply having a first power terminal coupled to the unique column driver, a second power terminal coupled to the unique row driver, and a control terminal connected to control power applied between the first and second power terminals in response to a control signal supplied to the control terminal; and controlling the controllable power supply to supply a unique control signal to the control terminal of the power supply whereby a unique amount of power is applied to the addressed circuit.

7. A method of supplying power to an array of light emitting devices as claimed in claim 6 wherein the step of controlling the controllable power supply includes sensing a voltage at the unique column driver and controlling the controllable power supply to maintain the sensed voltage substantially constant.

* * * * *